United States Patent [19]

Fontana

[11] Patent Number: 4,728,565

[45] Date of Patent: Mar. 1, 1988

[54] ELASTIC SUPPORT MEMBER FOR SUPPORTING STUFFING OF FURNITURE PIECES

[75] Inventor: Anacleto Fontana, Monza, Italy

[73] Assignee: Cintel S.a.s. di Fontana A. & C., Italy

[21] Appl. No.: 932,722

[22] Filed: Nov. 19, 1986

[51] Int. Cl.[4] ..... B32B 7/00

[52] U.S. Cl. ..... 428/255; 428/229; 428/230; 428/231; 428/257

[58] Field of Search ..... 428/257, 258, 259, 226, 428/229, 230, 231, 255

[56] References Cited

U.S. PATENT DOCUMENTS

| | | | |
|---|---|---|---|
| 4,433,493 | 2/1984 | Poisson | 428/229 |
| 4,469,739 | 9/1984 | Gretzinger et al. | 428/255 |
| 4,632,863 | 12/1986 | Henningsson | 428/229 |

FOREIGN PATENT DOCUMENTS

| | | |
|---|---|---|
| 572629 | 3/1954 | Canada . |
| 0019422 | 5/1986 | Japan . |
| 1120742 | 6/1986 | Japan . |

*Primary Examiner*—James J. Bell

*Attorney, Agent, or Firm*—Lerner, David, Littenberg, Krumholz & Mentlik

[57] ABSTRACT

The elastic support member for supporting stuffing of furniture pieces such as for example beds, chairs and the like is of the type comprising an elastic net or belt formed of a net or honeycomb fabric or a woven fabric comprised of rubber threads or the like arranged at least in one of the transverse and longitudinal directions. The rubber threads or the like are covered with loops made of chain-stitches.

5 Claims, 3 Drawing Figures

ELASTIC SUPPORT MEMBER FOR SUPPORTING STUFFING OF FURNITURE PIECES

BACKGROUND OF THE INVENTION

Field of the Invention

This invention relates to elastic supports for supporting stuffing or upholstery of furniture pieces such as bedsprings, beds chairs and the like and more particularly an improved support member of the type referred to.

Description of the Prior Art

The use of elastic belts for supporting the stuffing or upholster in furniture pieces such as seats, backs, arm rests, backboards, motorvehicle seats and backs and the like is well known. The elastic belts of this kind at present in use are affected by various disadvantages such as for example a lack of uniform spring suspension because each belt applied to the supporting frame has not the same tension as the other belts which are stretched and applied one at a time and therefore the more stretched belt "works" more than the other belts and supports alone all the weight of the user thereby fringing and breaking prematurely and causing also the other belts to fringe and break. These elastic belts have been improved by the Applicant by providing on the elastic threads a spirally wound covering formed of natural or synthetic yarns.

From the Italian Patent No. 955 134 a support of this kind is also known, which comprises an elastic net formed of a net or honeycomb fabric made of rubber threads or the like arranged at least in one of the transverse and longitudinal directions, which rubber threads are covered with a plurality of spirally wound yarns and preferably crossed in the other direction by elastic or not elastic threads of nylon or cotton or other suitable textile fibers.

However, also this support is affected by drawbacks due to the fact that the plurality of spirally wound yarns, while overcoming the drawback of the uniform spring suspension, require expensive working operations and the use of a great amount of textile yarn, which makes the spiral winding very expensive.

In an attempt to overcome this drawback, use is made of a yarn spirally wound in one direction and a yarn spirally wound in the opposite direction, but this has not solved the problems that the spiral winding involves.

Therefore the elastic threads covered by a plurality of spirally wound yarns, in spite of the precautions taken, lead to tension differences of the covered elastic threads at the time of their manufacture, what gives effect of false twisting and ondulations of the elastic support members obtained thereby.

SUMMARY OF THE INVENTION

This invention aims at improving the above mentioned elastic support member by applying to the elastic threads a covering of a character quite different which permits a correct tensioning of the elastic threads to take place thereby saving the expensive spiral windings till now employed as well ad the various operations necessary to obtain this spiral winding.

More particularly the elastic support member according to the present invention is formed of an elastic net or belt of a net of honeycomb fabric or the like or a woven fabric having at least in one of the transverse longitudinal directions rubber threads or the like, said rubber threads or the like being covered by loops formed chain-stitches. The so obtained elastic net has a better resistance and stability than those formed of elastic threads covered with a plurality of spiral windings.

DESCRIPTION OF THE PREFERRED EMBODIMENT

Figure 1:
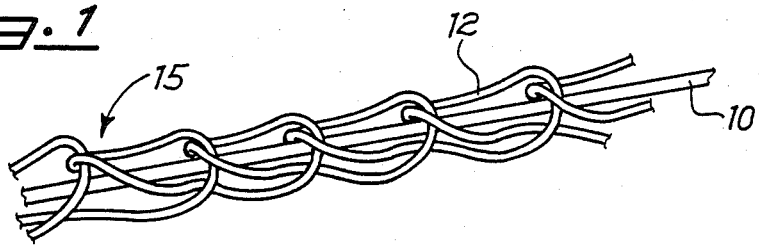
FIG. 1 shows in a perspective view and on an enlarged scale the covering loops made of chain-stitches and arranged about on elastic thread.

As can be seen in FIG. 1, the elastic thread to be covered, designated by 10, is generally formed of a rubber or elastomeric thread and is covered with loops 12 made of chain-stitches. The latter comprise synthetic yarns. The covered thread is designated by 15.

Figure 2:
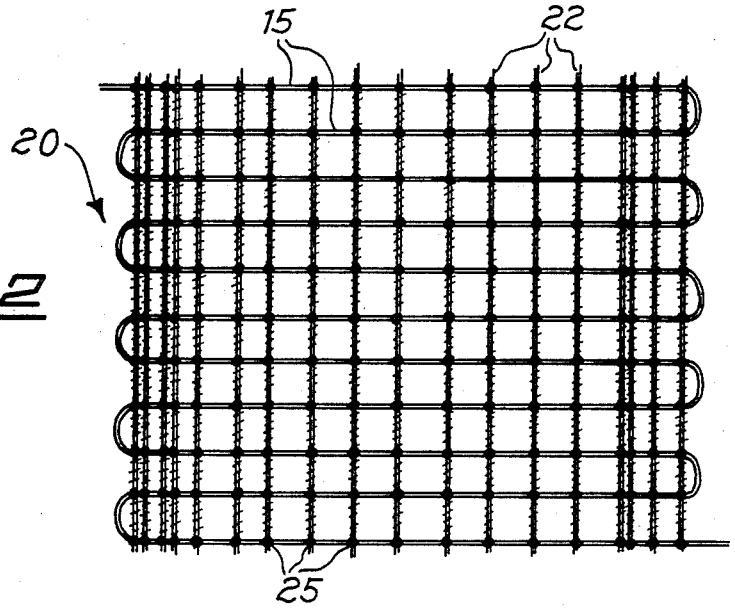
FIG. 2 diagrammatically shows an elastic net fabric obtained through the use of the covered elastic threads of FIG. 1.

In FIG. 2 a portion of an elastic support member 20 is obtained from an elastic net fabric, as for example the fabric described in the above mentioned Italian Patent, wherein however the rubber threads are covered as shown in FIG. 1. This net is formed of the covered horizontally arranged elastic threads 15 and vertically arranged chain-stitch threads 22 of textile material. The covered elastic threads 15 exhibit some roughness so that a better retaining action without slipping at the cross-points 25 is obtained. Otherwise the net 20 is formed as described in the above mentioned Italian Patent, which is referred to for a better understanding of the invention.

Figure 3:
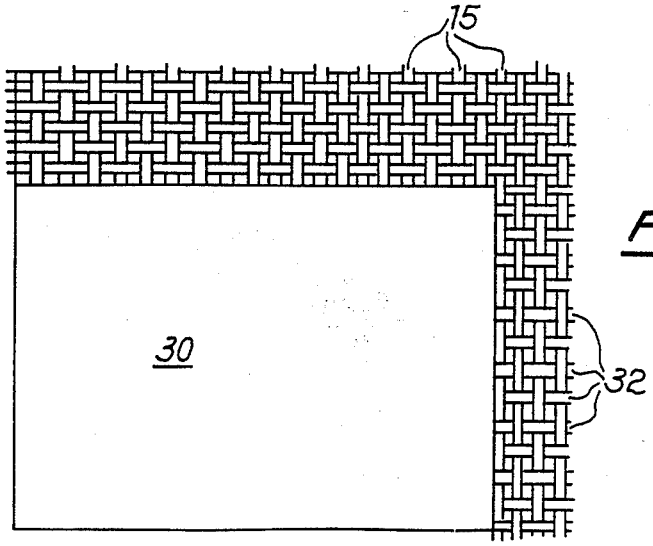
FIG. 3 shows, also in a diagrammatic manner, a woven elastic belt obtained through the use of the covered elastic threads of FIG. 1.

In FIG. 3 a portion of elastic belt 30 is shown, which is obtained from a fabric wherein the rubber threads or the like are covered as shown in FIG. 1. This elastic belt comprises the covered elastic threads 15 as chain threads and the textile threads 32 as weft threads.

From the foregoing it will be readily apparent that the improvement obtained by covering the elastic threads with loops made of chain-stitches with respect to the covering made of spiral windings offers the advantages of employing a very smaller quantity of textile material than that required by the plurality of spiral windings and of giving a more perfect tensioning of the covered elastic threads so that there will not be the effects of false-twisting and ondulations of the finished product.

As it is well known, the covered elastic threads are preferably made on lappet looms and then woven to form the elastic support member also on lapper looms or on looms with or without shuttle.

Furthermore, the elastic thread covered in accordance with the present invention has the further advantage of being retained in the loops made of chain-stitches, in contrast with the case of the spirally wound thread where the winding was brought by the elastic thread so that there are not dangers of breaks of the covering.

Of course, the so covered elastic threads can also be arranged in both directions so as to give a support which is elastic in both directions.

I claim:

1. An elastic support member for supporting the stuffing or upholstery of furniture pieces wherein said support member is formed of an elastic fabric having at least in one of the transverse longitudinal directions thereof rubber threads, said rubber threads being covered by loops formed by yarn stitches.

2. An elastic support member as claimed in claim 1, wherein said rubber threads are covered by loops made of chain stitches of synthetic yarn.

3. An elastic support member as claimed in claim 2, wherein said member is impregnated with latex.

4. An elastic net made from covered rubber threads as claimed in claim 2.

5. An elastic belt made from covered rubber threads as claimed in claim 2.

* * * * *

US004728565B1

REEXAMINATION CERTIFICATE (3601st)

United States Patent [19]

Fontana

[11] B1 4,728,565

[45] Certificate Issued Aug. 18, 1998

[54] ELASTED SUPPORT MEMBER FOR SUPPORTING STUFFING OF FURNITURE PIECES

[75] Inventor: Anacleto Fontana, Monza, Italy

[73] Assignee: Cintel S.A.S. Di Fontana A. & C.

Reexamination Request:
No. 90/003,431, May 12, 1994

Reexamination Certificate for:

| | |
|---|---|
| Patent No.: | **4,728,565** |
| Issued: | **Mar. 1, 1988** |
| Appl. No.: | **932,722** |
| Filed: | **Nov. 19, 1986** |

[51] Int. Cl.[6] ..... B32B 7/00

[52] U.S. Cl. ..... 442/60; 442/58; 442/182; 442/189; 442/203; 442/208; 442/306

[58] Field of Search ..... 428/229, 230, 428/231, 257, 255; 442/58, 60, 182, 189, 203, 208, 306

[56] References Cited

U.S. PATENT DOCUMENTS 4,728,565 3/1988 Fontana ..... 428/255

FOREIGN PATENT DOCUMENTS 7200862 11/1973 France .
955134 9/1973 Italy .

*Primary Examiner*—James J. Bell

[57] ABSTRACT

The elastic support member for supporting stuffing of furniture pieces such as for example beds, chairs and the like is of the type comprising an elastic net or belt formed of a net or honeycomb fabric or a woven fabric comprised of rubber threads or the like arranged at least in one of the transverse and longitudinal directions. The rubber threads or the like are covered with loops made of chain-stitches.

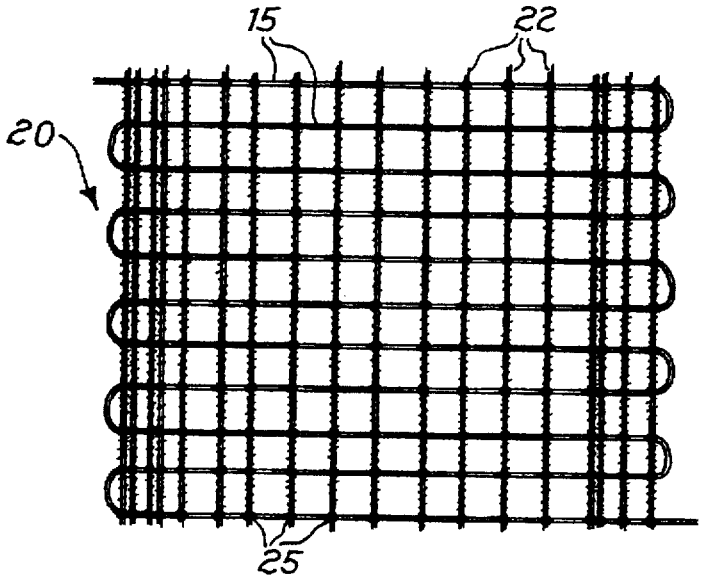

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–5 are cancelled.

* * * * *